US006488560B2

(12) United States Patent
Nishikawa

(10) Patent No.: US 6,488,560 B2
(45) **Date of Patent: *Dec. 3, 2002**

(54) WALKING APPARATUS

(75) Inventor: Yoshio Nishikawa, Tochigi (JP)

(73) Assignee: Kabushiki Kaisha Bandai, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/410,554

(22) Filed: Oct. 1, 1999

(65) Prior Publication Data

US 2002/0025756 A1 Feb. 28, 2002

(30) Foreign Application Priority Data

Oct. 9, 1998 (JP) ..... 10-288210
Aug. 24, 1999 (JP) ..... 11-237081

(51) Int. Cl.[7] ..... A63H 7/00

(52) U.S. Cl. ..... 446/356; 446/353; 446/352; 446/330

(58) Field of Search ..... 446/352, 353, 446/355, 356, 431, 374, 373, 383, 382, 380, 377, 376, 390, 368

(56) References Cited

U.S. PATENT DOCUMENTS 1,382,854 A * 6/1921 Rasmussen ..... 901/1
2,827,735 A * 3/1958 Grimm, Jr. ..... 446/356
3,331,463 A * 7/1967 Kramer ..... 446/356
3,678,617 A * 7/1972 Nomura ..... 446/356
4,614,504 A * 9/1986 Yamasaki ..... 446/356
4,629,440 A * 12/1986 McKittrick, Jr. et al. ... 446/356
4,738,583 A * 4/1988 Macconochie et al. ..... 901/1
4,862,980 A * 9/1989 Shkolnik ..... 901/1
4,884,989 A * 12/1989 Wong ..... 446/431
5,423,708 A * 6/1995 Allen ..... 446/356
5,683,285 A * 11/1997 Wong ..... 446/431
5,857,533 A * 1/1999 Clewett ..... 901/1
6,068,073 A * 5/2000 Roston et al. ..... 901/1

FOREIGN PATENT DOCUMENTS

| | | |
|---|---|---|
| JP | 34-527 | of 1959 |
| JP | 50-8702 | 3/1975 |
| JP | 58-8701 | 3/1975 |
| JP | Sho62-26144 | 7/1987 |
| JP | 3-49745 | 10/1991 |
| JP | 5-86392 | 11/1993 |
| JP | 3023614 | 2/1996 |

* cited by examiner

*Primary Examiner*—Derris H. Banks
*Assistant Examiner*—Urszula M Cegielnik
(74) *Attorney, Agent, or Firm*—Luce, Forward, Hamilton & Scripps LLP

(57) ABSTRACT

A walking apparatus having an appearance similar to a real insect and capable of taking movements similar to those of a real insect is provided. A walking apparatus comprises a body and at least two of leg portions provided in the left and the right sides of the body. A power source and a plurality of gear wheels rotated by the power source are provided inside the body. The leg portions have rear parts mounted in the body, which are mounted in the rotational centers of the gear wheels and are made to be rotated on their axes. The leg portions can be bent and are formed such that they can retain the bent posture.

28 Claims, 7 Drawing Sheets

WALKING APPARATUS

BACKGROUND OF THE INVENTION

1. Field of the Invention

This invention relates to a walking apparatus such as an insect toy.

2. Description of the Prior Art

A known conventional walking apparatus, such as an insect toy is swingably provided with a front leg stick, a middle leg stick and a rear leg stick under its body, which are swung to advance by sliding the body on a walking surface as described in the published Japanese utility model application sho62-26144.

The conventional walking apparatus, such as an insect toy, has a problem of being unrealistic because it is swingably provided with a front leg stick, a middle leg stick and a rear leg stick under its body, whereas an actual insect has legs extending from its body. In addition, there is a problem that the conventional walking apparatus, such as an insect toy, cannot overcome even a small gap and stops because of its sliding movement, hence its movement is entirely different from that of an actual insect that can overcome such a gap.

SUMMARY OF THE INVENTION

In view of the deficiencies in the known apparatus, it is the object of the present invention to provide a walking apparatus capable of taking motions similar to those of an actual insect.

In order to attain the above and other objects, a walking apparatus in accordance with a first aspect of the present invention comprises:

(a) a body and at least two leg portions provided in the left and the right sides of the body respectively;

(b) a power source provided inside the body;

(c) the leg portions made rotatable on their axes by the power source inside the body; and (d) the leg portions that can be bent and is formed such that the bent posture can be retained.

In order to attain the above and other objects, a walking apparatus in accordance with the second aspect of the present invention comprises:

(a) a body and at least two leg portions provided in the left and the right sides of the body respectively;

(b) a power source and a plurality of gear wheels rotated by the power source that are provided inside the body;

(c) the leg portions depressed into the body in their rear parts, mounted in the rotational centers of the gear wheels and made rotatable on their axes; and (d) the leg portions that can be bent and is formed such that the bent posture can be retained.

In order to attain the above and other objects, a walking apparatus in accordance with the third aspect of the present invention further comprises contacting members formed of materials with high friction resistance attached on the top ends of the leg portions.

DETAILED DESCRIPTION OF THE INVENTION

Figure 1:
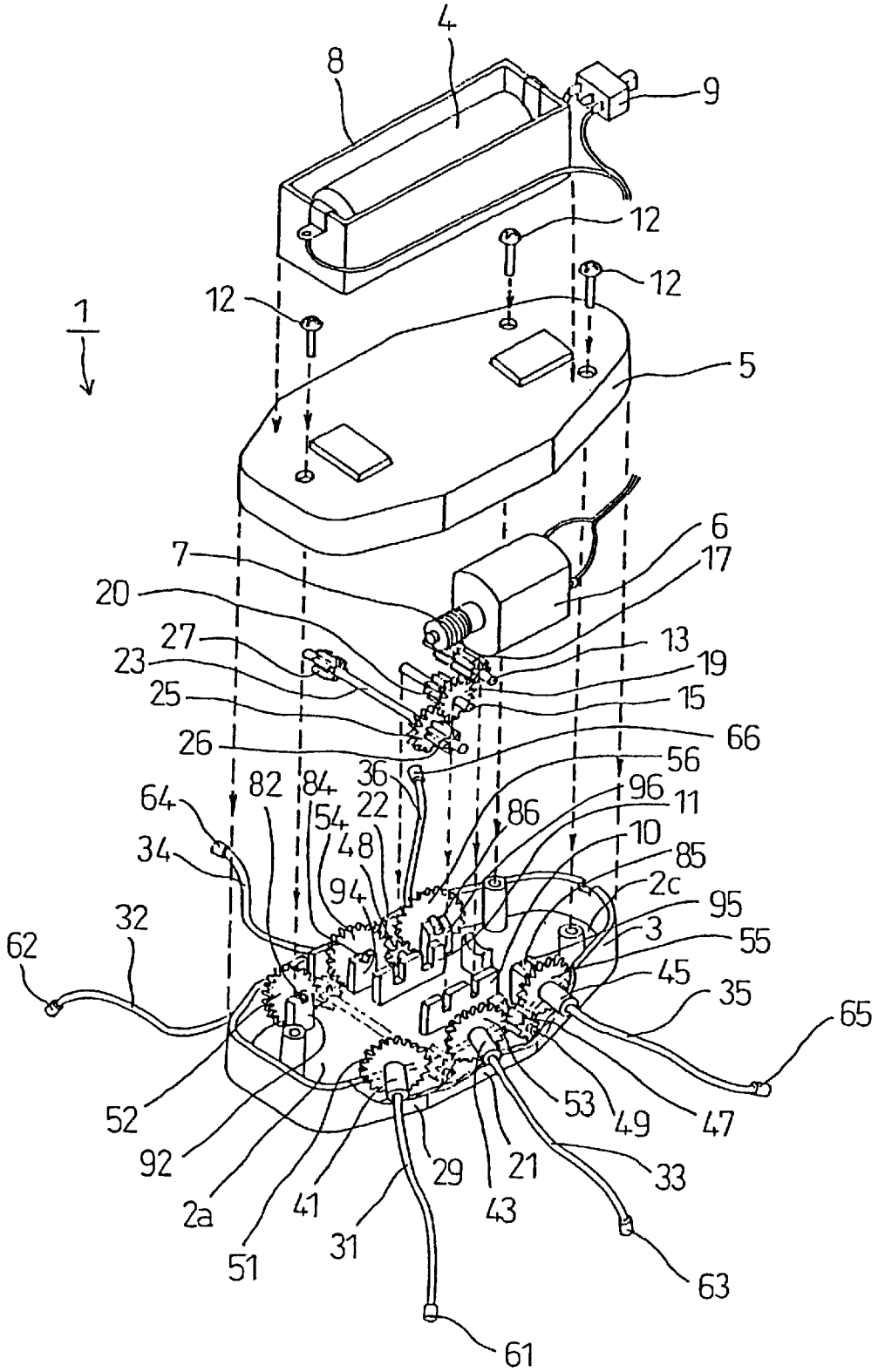
FIG. 1 is an overall exploded perspective view of a walking apparatus in accordance with the present invention.
Figure 2:
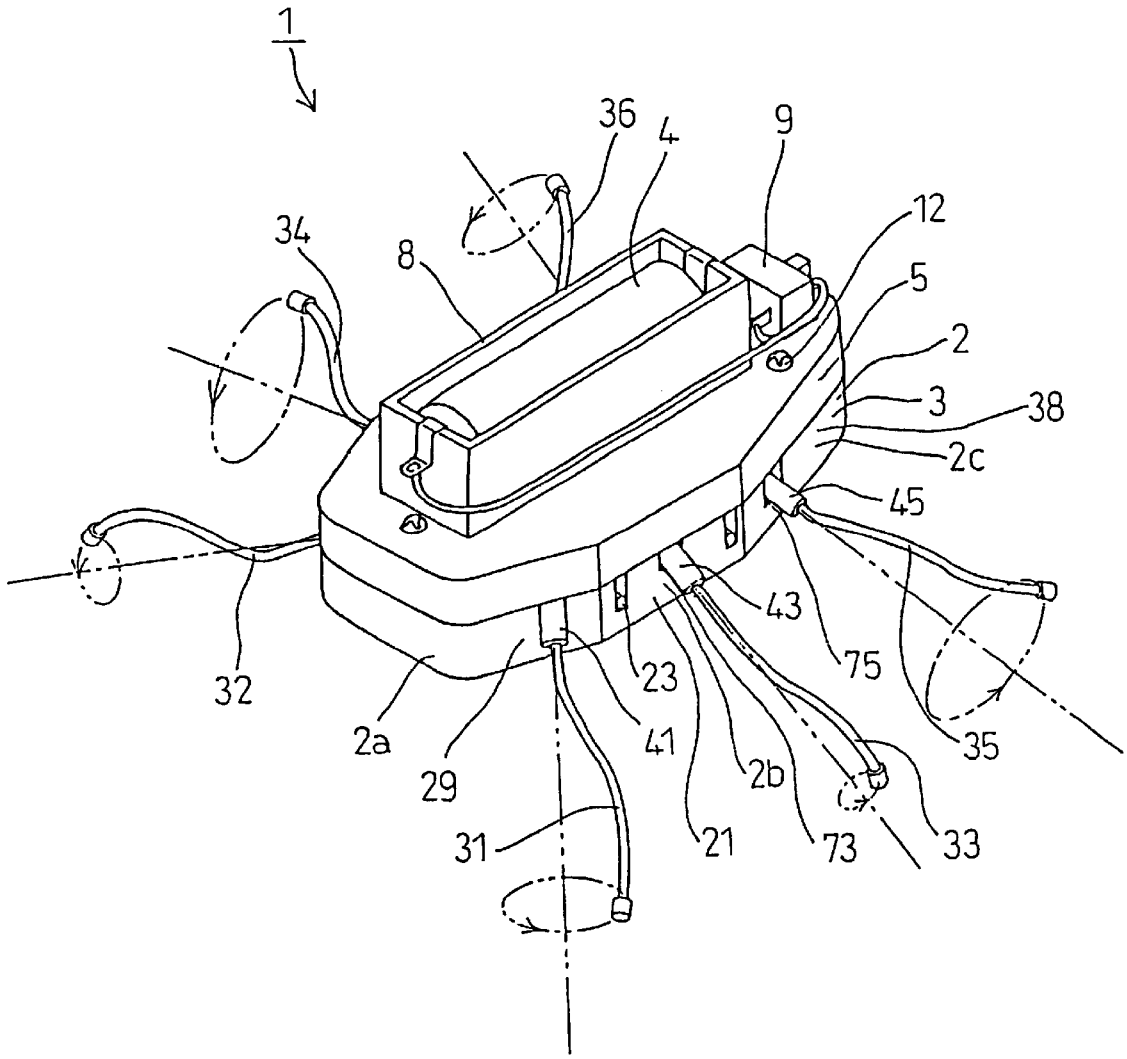
FIG. 2 is an assembled perspective view of FIG. 1.
Figure 3:
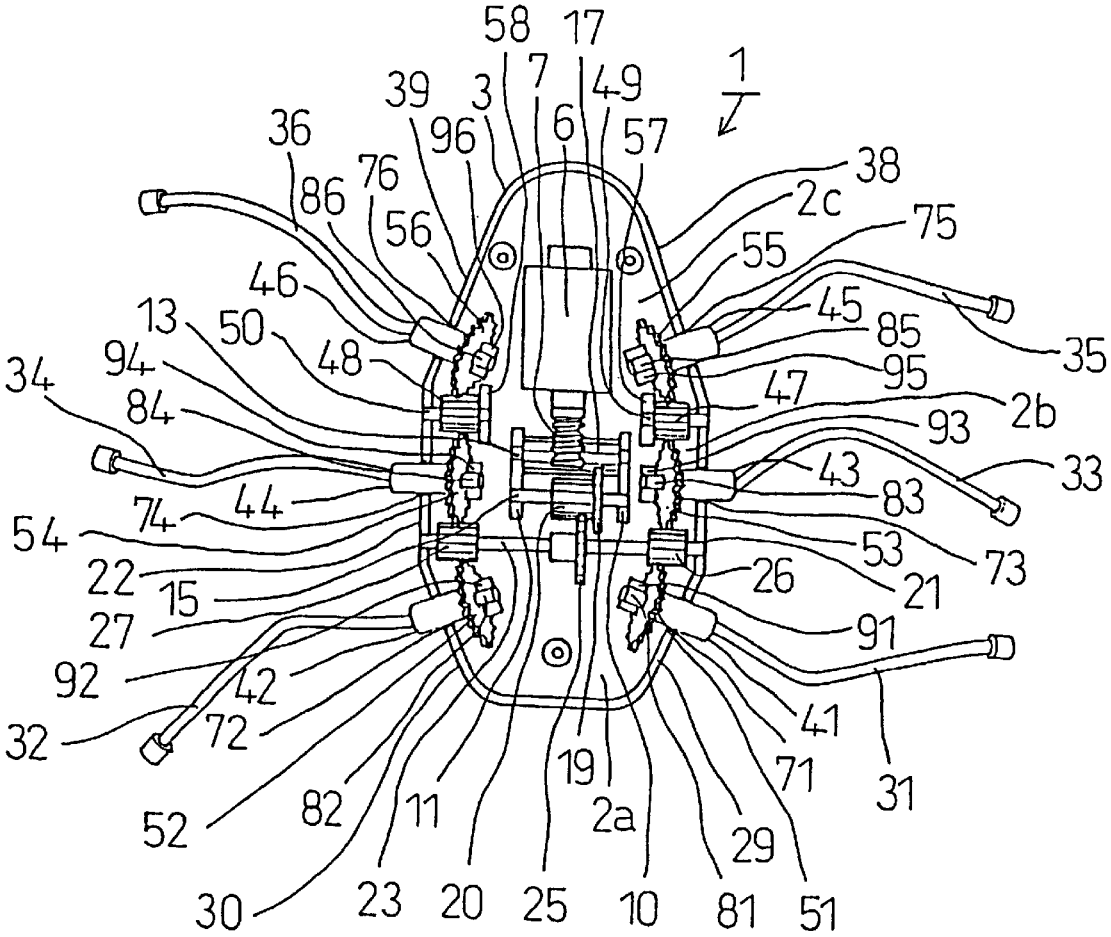
FIG. 3 is an assembled plan view of FIG. 1 partially omitted.
Figure 4:
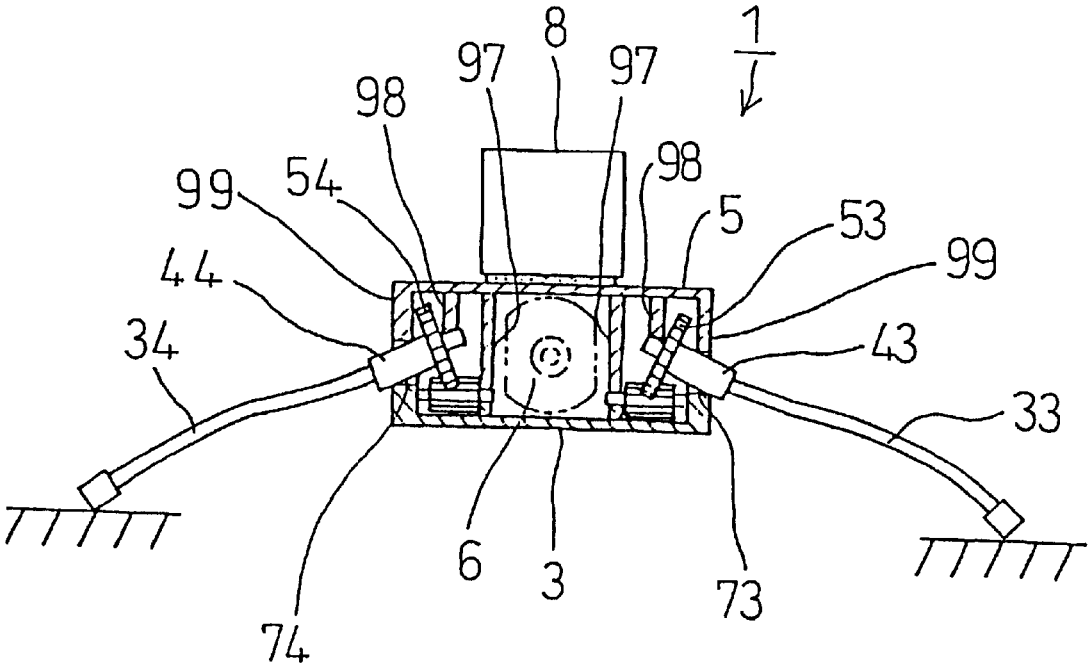
FIG. 4 is a front sectional view of FIG. 2.

A walking apparatus embodying the present invention is now described based on FIG. 1 through FIG. 4. A walking apparatus 1 in accordance with the first aspect of the present invention comprises a body 2 and at least two of leg portions 31 through 36 provided in the left and the right of the body 2. A power source 6 is provided inside the body 2. The leg portions 31 through 36 are made so as to rotate on their axes by the power source 6 inside the body 2. The leg portions 31 through 36 can be bent and are formed such that they can retain the bent posture.

When the top parts of the leg portions 31 through 36 touching a walking surface are slightly bent and the leg portions 31 through 36 are rotated forward on their axes by driving the power source 6, the walking apparatus 1 in accordance with the first aspect of the present invention can proceed forward with the top parts revolving forward in the up and down directions. On the other hand, when the leg portions 31 through 36 are rotated backward on their axes by driving the power source 6, the walking apparatus 1 moves backward with the top parts revolving backward. Since the walking apparatus 1 moves with the top parts of the leg shafts 31 through 36 that contact the walking surface, the body 2 also moves up and down and the walking apparatus 1 can move in a rhythmic fashion.

A walking apparatus 1 in accordance with the second aspect of the present invention comprises a body 2 and at least two of leg portions 31 through 36 provided in the left and the right sides of the body 2. A power source 6 and a plurality of gear wheels 51 through 56 that are rotated by the power source 6 are provided inside the body 2. The leg portions 31 through 36 have rear mounting parts inserted within the body 2, which are mounted in the rotational centers of the gear wheels 51 through 56 and are made to be rotated on their axes. The leg portions 31 through 36 can be bent and are formed such that they can retain the bent posture.

When the top parts of the leg portions 31 through 36 touching the walking surface are slightly bent and the plurality of gear wheels 51 through 56 are rotated by driving the power source 6, the leg portions 31 through 36 rotate forward on their axes and the walking apparatus 1 in accordance with the second aspect of the present invention can proceed forward with the top parts of the leg portions 31 through 36 revolving forward in the up and down directions. On the other hand, when the plurality of gear wheels 51 through 56 are rotated backward by driving the power source 6, the leg portions 31 through 36 rotates backward on their axes and the walking apparatus 1 proceeds backward with the top parts revolving backward in the up and down directions. Since the walking apparatus 1 moves with the top parts of the leg shafts 31 through 36 that contact the walking surface, the body 2 also moves up and down and the walking apparatus 1 can move in a rhythmic fashion.

A walking apparatus 1 in accordance with the first and the seconds aspects of the present invention can easily overcome somewhat uneven surfaces in its walking direction because it moves with the top parts of the leg portions 31 through 36 revolving forward in the up and down directions. When a plurality of walking apparatuses 1 are put in one box, they make moves that are similar to those of a real insect as a result of getting on each other's back, which is extremely realistic. Further, the direction of movement of all the leg portions 31 through 36 can be changed, and the movement of the entire walking apparatus can be unpredictably interesting because the directions of bending the leg portions 31 through 36 can be freely changed.

The leg portions 31 through 36 may be attached substantially in parallel with the body 2, but when they are attached as inclining downward from the body 2, the appearance of the walking apparatus 1 is more like a real insect, and the body 2 does not touch the walking surface when walking. Further, the power source 6 is not limited to a driving motor, but a power spring, a flywheel and so on can be adopted as a power source. The power source 6 also is not limited to only to a single device but may include plural discrete power sources.

A walking apparatus in accordance with the third aspect of the present invention is assured to move on the walking surface without slipping because contacting members 61 through 66 formed of materials with high friction resistance are attached.

The above-mentioned walking apparatus is now further described below. A walking apparatus 1 in the form of an insect has a body 2. The body 2 consists of a lower body frame 3 and an upper body frame 5, which is attached to the lower body frame 3 by a screw 12 and so on, and is provided with a front body part 2*a,* which has narrower width toward the front direction, a middle body part 2*b* with fixed width and a rear body part 2*c* with narrower width toward the rear direction. A driving motor 6 is fixedly attached to the lower body frame 3. A worm gear wheel 7 is fixedly attached to a driving shaft of the driving motor 6.

A pair of bearing members 10 and 11 are mounted substantially in the middle of the lower body frame 3, and a first middle shaft 13 and a second middle shaft 15 are rotatably attached between the pair of bearing members 10 and 11. A small gear wheel 17 meeting with the worm gear wheel 7 is provided on the first middle shaft 13. A spur gear wheel 19 meeting with the small gear wheel 17 and a small gear wheel 20 forming one body with the spur gear wheel 19 are provided on the second middle shaft 15.

A transmission shaft 23 is rotatably attached to both side walls 21 and 22 of the middle body part 2*b* of the lower body frame 3. The transmission shaft 23 is fixedly attached substantially in the middle of a super gear wheel 25 meeting with the small gear wheel 20 and is fixed to small gear wheels 26 and 27 at both ends.

Leg shafts 31 and 32 are rotatably attached to both sides of the front body part 2*a* of the lower body frame 3. Leg shafts 33 and 34 are rotatably attached to both sides of the middle body part 2*b* of the lower body frame 3. Leg shafts 35 and 36 are rotatably attached to both sides of the rear body part 2*c* of the lower body frame 3. The leg shafts 31 through 36 can be bent and are formed of materials that can retain the bent posture, such as wire and plastic wire, and fixed with their rear parts inserted in tubular members 41 through 46 in cylindrical shape. Dependent gear wheels 51 through 56 are solidly provided in the housings 41 through 46. Contacting members 61 through 66 are tubular in shape with a bottom plate made of a material having high friction resistance, such as rubber, are insertedly attached to the top parts of the leg shafts 31 through 36.

The leg shafts 31 and 32 have the tubular members 41 and 42 rotatably borne by bearing portions 71 and 72 formed on both side walls 29 and 30 of the front body part 2*a* of the lower body frame 3 and the rear end parts 81 and 82 of the leg shafts 31 and 32 protruding from the dependent gear wheels 51 and 52 rotatably borne by bearing chips 91 and 92. Since the bearing position of the bearing chips 91 and 92 is set to be higher than the bearing portions 71 and 72, the leg shafts 31 and 32 incline downward against the body 2.

The leg shafts 33 and 34 have tubular members 43 and 44 rotatably born by bearing portions 73 and 74 formed in both side walls 21 and 22 of the middle body part 2*b* of the lower body frame 3 and rear end parts 83 and 84 of the leg shafts 33 and 34 protruding from the dependent gear wheels 53 and 54 rotatably borne by bearing chips 93 and 94. Since the bearing position of the bearing chips 93 and 94 is set to be higher than the bearing portions 73 and 74, the leg shafts 33 and 34 incline downward against the body 2.

The leg shafts 35 and 36 have tubular members 45 and 46 rotatably born by bearing portions 75 and 76 formed in both side walls 38 and 39 of the middle body part 2*c* of the lower body frame 3 and rear end parts 85 and 86 of the leg shafts 35 and 36 protruding from the dependent gear wheels 55 and 56 rotatably borne by bearing chips 95 and 96. Since the bearing position of the bearing chips 95 and 96 is set to be higher than the bearing portions 75 and 76, the leg shafts 35 and 36 incline downward against the body 2.

Since both the side walls 29 and 30 of the front body part 2*a* of the lower body frame 3 incline inwardly against both the side walls 21 and 22 of the middle body part 2*b,* the leg shafts 31 and 32 incline away from the leg shafts 33 and 34 toward their top ends. Further, since both the side walls 38 and 39 of the rear body part 2*c* of the lower body frame 3 incline inwardly against both the side walls 21 and 22 of the middle body part 2*b,* the leg shafts 35 and 36 incline away from the leg shafts 33 and 34 toward their top ends.

The dependent gear wheels 51 and 52 of the leg shafts 31 and 32 and the dependent gear wheels 53 and 54 of the leg shafts 33 and 34 meet with the small gear wheels 26 and 27 of the transmission shaft 23. Further, the dependent gear wheels 53 and 54 of the leg shafts 33 and 34 and the dependent gear wheels 55 and 56 of the leg shafts 35 and 36 meet with middle small gear wheels 47 and 48. Rotational shafts 49 and 50 of the middle small gear wheels 47 and 48 are rotatably attached to the side walls 21 and 22 of the middle body part 2*b* of the lower body frame 3 and bearing chips 57 and 58.

The first middle shaft 13, the second middle shaft 15, the transmission shaft 23, rear end parts 81 through 86 of the leg shafts 31 through 36, the tubular members 41 through 46 and the rotational shafts 49 and 51, all rotatably attached to the lower body frame 3, are pressed by protrusions 97 and 98 mounted on the upper body frame 5 and surrounding wall 99.

A battery box 8 housing a battery 4 is provided in the upper part of the upper body frame 5, and the battery box 8 and the driving motor 6 are electrically connected through a switch 9, but the battery 4 may be a button battery housed inside the body 2.

In the above-described walking apparatus 1 in the form of an insect toy, the driving motor 6 is driven when the switch 9 is turned on, and the driving motor 6 is stopped when the switch 9 is turned off. The top ends of the leg shafts 31 through 36 touching the walking surface are slightly bent. When the switch 9 is turned on and the driving motor 6 is driven, the worm gear wheel 7 rotates. The rotation of the worm gear wheel 7 is transmitted to the transmission shaft 23 through the small gear wheel 17, the spur gear wheel 19, the small gear wheel 20 and the spur gear wheel 25 meeting with the worm gear wheel 7 and causes the small gear wheels 26 and 27 on both ends of the transmission shaft 23 to rotate.

The rotations of the small gear wheels 26 and 27 are transmitted to the leg shafts 31 and 32 through the dependent gear wheels 51 and 52, the leg shafts 31 and 32 rotate forward on their axes and the top parts of the leg shafts 31 and 32 revolve forward in the up and down directions. Further, the rotations of the small gear wheels 26 and 27 are transmitted to the leg shafts 33 and 34 through the dependent gear wheels 53 and 54, the leg shafts 33 and 34 rotate forward on their axes and the top parts of the leg shafts 33 and 34 revolve forward in the up and down directions.

Moreover, the rotations of the dependent gear wheels 53 and 54 are transmitted to the leg shafts 35 and 36 through the middle small gear wheels 47 and 48 and the dependent gear wheels 55 and 56, the leg shafts 35 and 36 rotate forward on their axes and the top parts of the leg shafts 35 and 36 revolve forward in the up and down directions. Thus, when the leg shafts 31 through 36 are caused to rotate forward on their axes, the top parts of the leg shafts revolve forward in the up and down directions, and the walking apparatus 1 proceeds forward. Since the walking apparatus 1 moves with the top parts of the leg shafts 31 through 36 that contact the walking surface, the body 2 also moves up and down and the walking apparatus 1 can move rhythmically. Since the contacting members 61 through 66 formed of materials with high friction resistance are attached to the top ends of the leg shafts 31 through 36, the walking apparatus 1 can move on the walking surface without slipping.

Figure 5:
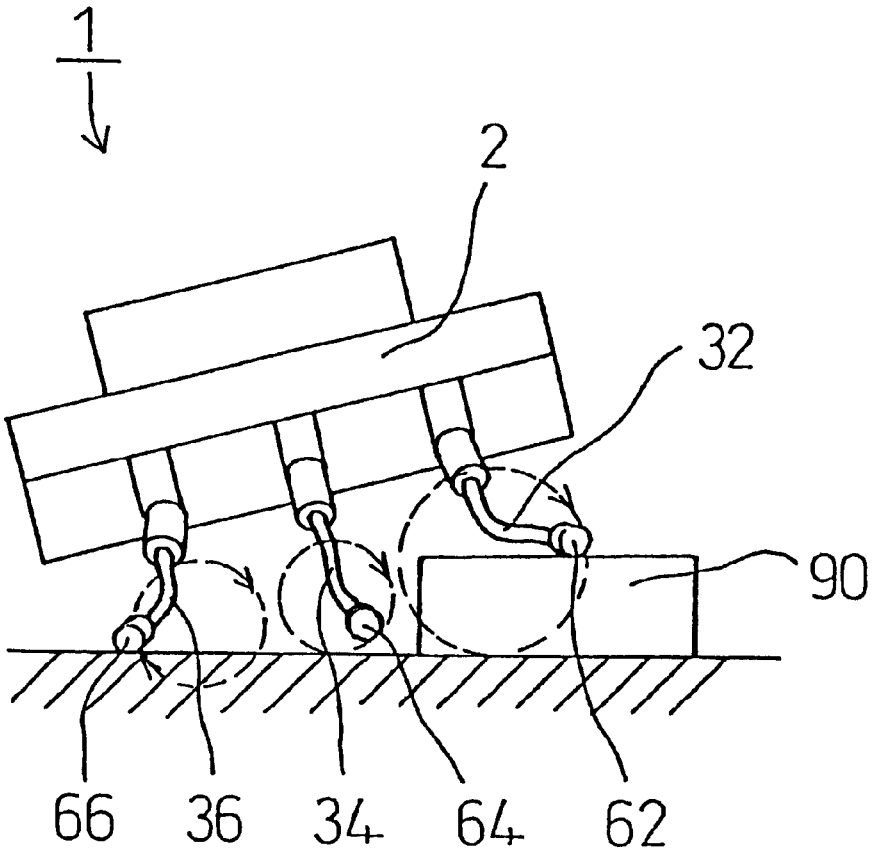
FIG. 5 is a side elevational view describing motions of a walking apparatus.

Since the walking apparatus 1 moves with the top parts of the leg shafts 31 through 36 revolving in the up and down directions, it can easily overcome a projected part 90 on its way as shown in FIG. 5. When a plurality of walking apparatuses 1 are put in one box, they make moves that are similar to that of a real insect as a result of getting on each other's back, which is extremely realistic. Further, the directions of movements of all the leg portions 31 to 36 can be changed, and the movement of the entire walking apparatus can be unpredictably interesting because the directions of bending the leg portions 31 to 36 can be freely changed.

The leg shafts 31 through 36 of the walking apparatus 1 are attached as inclining downward from the body 2, such that the appearance of the walking apparatus 1 is more like a real insect, and the body 2 does not touch the walking surface when walking. Further, the power source 6 is not limited to a driving motor, but a power spring, a flywheel and so on can be adopted as a power source.

Figure 6:
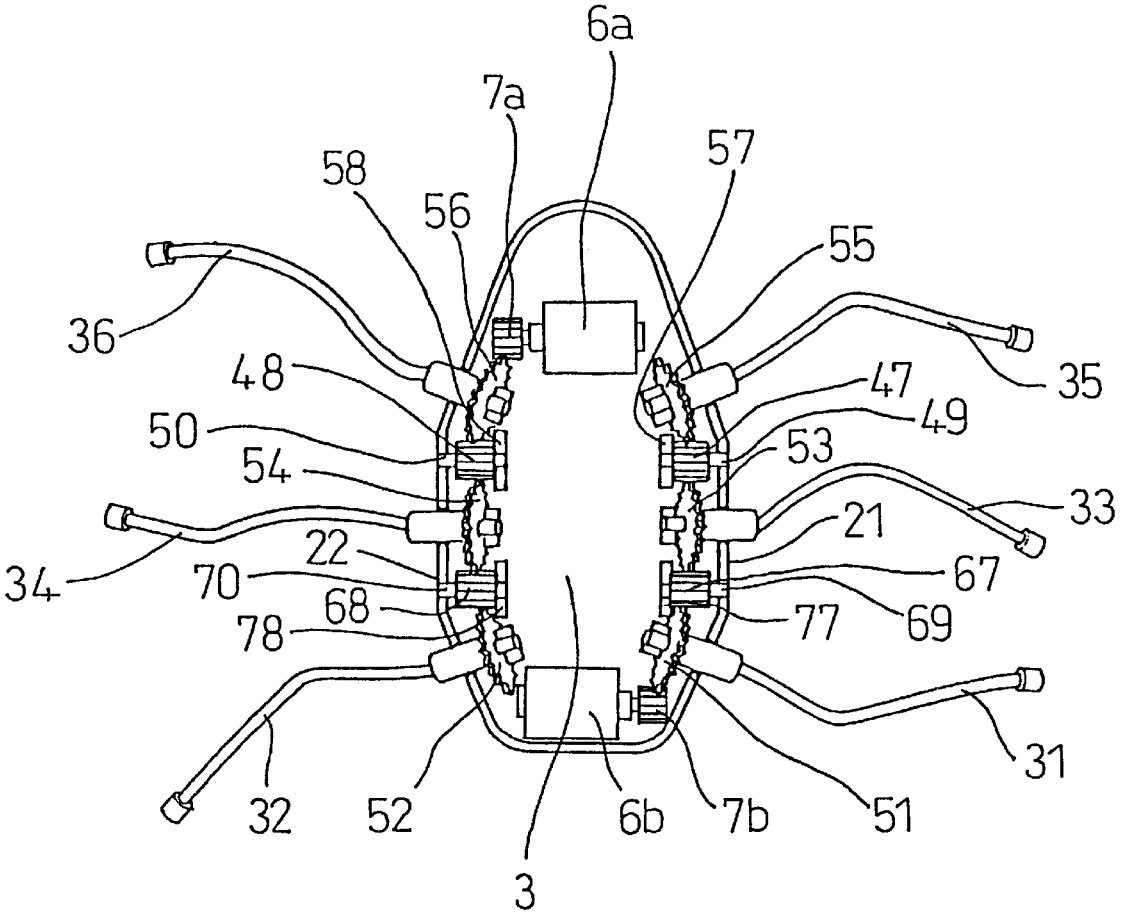
FIG. 6 is an assembled plan view describing other mechanisms of FIG. 3.

Moreover, the power source 6 is not limited to only one but may be plural. For example, as shown in FIG. 6, middle small gear wheels 67 and 68 meeting with the dependent gear wheels 51 and 52 and the dependent gear wheels 53 and 54 are provided between the dependent gear wheels 51 and 52 of the leg shafts 31 and 32 and the dependent gear wheels 53 and 54 of the leg shafts 33 and 34, and rotational shafts 69 and 70 of the middle small gear wheels 67 and 68 are rotatably attached to the side walls 21 and 22 of the middle body part 2*b* of the lower body frame and bearing chips 77 and 78. One of the gear wheels of the left line of gear wheels, for example, the dependent gear wheel 56 is met with the driving small gear wheel 7*a* of the driving motor 6*a* fixedly attached to the lower body frame 3. Further, one of the gear wheels of the right line of gear wheels, for example, the dependent gear wheel 51, is met with the driving small gear wheel 7*b* of the driving motor 6*b* fixedly attached to the lower body frame 3.

The walking apparatus 1 structured as above can simultaneously rotate the left leg shafts 32, 34 and 36 by the one driving motor 6*a* and can simultaneously rotate the right leg shafts 31, 33 and 35 by the other driving motor 6*b*. The walking apparatus 1 proceeds forward or backward in the same manner as described above when the driving motors 6*a* and 6*b* are rotated positively or reversibly in the same direction. Further, the walking apparatus 1 can change its direction because, when only the one driving motor 6*a* is driven, only the left leg shafts 32, 34 and 36 simultaneously rotate and when only the other driving motor 6*b* is driven, the right leg shafts 31, 33 and 35 simultaneously rotate. Moreover, the walking apparatus 1 instantly turns over because, when the one driving motor 6*a* and the other driving motor 6*b* are driven in different rotational direction, the rotational direction of the left leg shafts 32, 34 and 36 and the rotational direction of the right leg shafts 31, 33 and 35 are different. Thus, the walking apparatus 1 has a wider range of movements and can be closer to a real insect's motions when a plurality of driving motors are provided.

Figure 7:
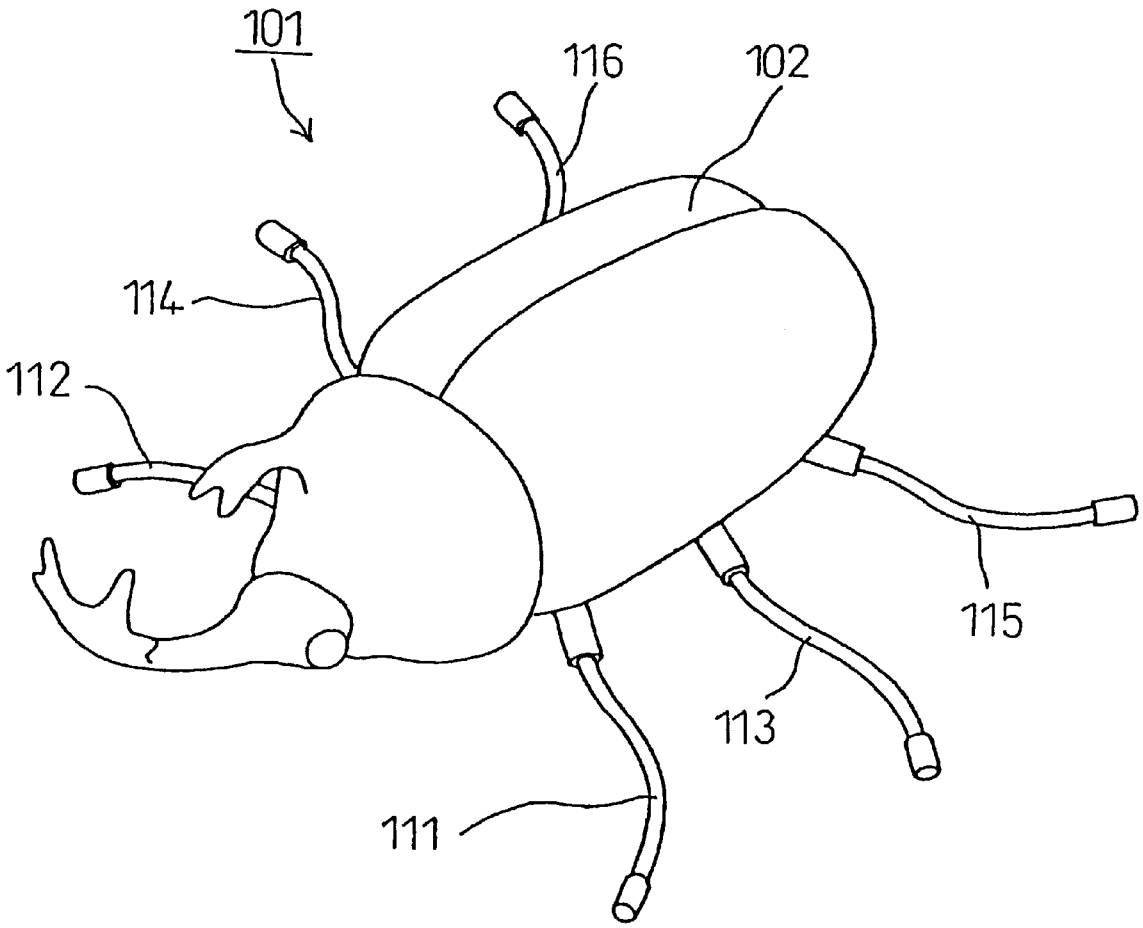
FIG. 7 is a perspective view of an appearance of a walking apparatus.

The shape of the body 2 of the walking apparatus 1 is not specifically limited, but various shapes may be adopted. For example, as shown in FIG. 7, the shape of a body 102 is formed in the shape of a beetle, a driving motor and a button battery are contained in the body 102 and leg shafts 111 through 116 rotated by the driving motor are provided in the lower side of the body 102, which make the walking apparatus 101 in the shape of a beetle. The shape may be that of a grasshopper, a green caterpillar and so on.

The walking apparatus according to the first and second aspects of the present invention has the effect that it has a shape similar to a real insect because it is provided with leg portions extending from inside the body. It also has the effect that it can move rhythmically like a real insect because it moves with the top parts of the leg portions contacting the walking surface while the body moves up and down. Further, it can easily overcome uneven surfaces in its way because it walks with the top parts of the leg portions taking such motions as revolving in the up and down directions. When a plurality of walking apparatuses are put in one box, they make moves that are similar to that of a real insect as a result of getting on each other's back, which is extremely realistic. Moreover, the directions of movements of all the leg portions can be changed and the movement of the entire walking apparatus can be unpredictably interesting because the directions of bending the leg portions can be freely changed.

The walking apparatus according to the third aspect of the present invention has the effect that it can move on the walking surface without slipping because contacting members formed of a material with high friction resistance are attached at the top of the leg portions.

Thus, it is seen that a walking apparatus is provided. One skilled in the art will appreciate that the present invention can be practiced by other than the preferred embodiments which are presented for the purposes of illustration and not of limitation, and the present invention is limited only by the claims that follow:

What is claimed is:

1. A walking toy comprising:

a body and at least two leg portions provided in the left and right sides of the body respectively;

a power source provided inside said body;

said leg portions made rotatable by the power source inside said body, each of said leg portions being coupled to a respective gear wheel having a respective axis of rotation, each of said leg portions and the respective gear wheel rotating around the respective axis of rotation;

said leg portions are rotatably borne by bearing portions and bearing chips, wherein the bearing position of the bearing chips is set to be higher than the bearing portions so that the leg portions incline downward against the body.

2. A walking toy according to claim 1, wherein said leg portions are bendable and formed of a material that can retain a bent posture.

3. A walking toy comprising:

a body and at least two leg portions provided in the left and right sides of the body respectively;

a power source and a plurality of gear wheels rotated by the power source, the power source and a plurality of gear wheels provided inside the body;

each of said leg portions having a bottom portion and top portion, the top portion mounted within said body on a respective one of said gear wheels at the rotational center of the gear wheel;

said leg portions are rotatably borne by bearing portions and bearing chips, wherein the bearing position of the bearing chips is set to be higher than the bearing portions so that the leg portions incline downward against the body.

4. A walking toy according to claim 3, wherein said leg portions are bendable and formed of a material that can retain a bent posture.

5. A walking toy according to claim 1, wherein each of said leg portions includes a top end and further comprising contacting members formed of materials with high friction resistance attached on the top end of each of said leg portions.

6. A walking toy according to claim 2, wherein each of said leg portions includes a top end and further comprising contacting members formed of materials with high friction resistance attached on the top end of each of said leg portions.

7. A walking toy according to claim 3, wherein each of said leg portions includes a top end and further comprising contacting members formed of materials with high friction resistance attached on the top end of each of said leg portions.

8. A walking toy according to claim 4, wherein each of said leg portions includes a top end and further comprising contacting members formed of materials with high friction resistance attached on the top end of each of said leg portions.

9. A walking toy comprising:

a body having a left side and a right side;

at least two leg portions, each leg portion having a mounting portion, at least one said leg portion being in the left side of the body and at least one leg portion being in the right side of the body; and a power source provided inside said body and a plurality of gear wheels rotatably engaged by the power source provided inside said body, wherein the respective mounting portion of each leg portion is mounted in said body in the rotational center of a respective gear wheel and thereby made rotatable, and wherein said leg portions are rotatably borne by bearing portions and bearing chips, wherein the bearing position of the bearing chips is set to be higher than the bearing portions so that the leg portions incline downward against the body.

10. A walking toy according to claim 9, wherein said leg portions are bendable and formed of a material that can be retain a bent posture.

11. A walking toy of claim 1, wherein all of the leg portions are bent slightly and the walking toy crawls on the floor.

12. A walking toy of claim 2, wherein all of the leg portions are bent slightly and the walking toy crawls on the floor.

13. A walking toy of claim 3, wherein all of the leg portions are bent slightly and the walking toy crawls on the floor.

14. A walking toy of claim 4, wherein all of the leg portions are bent slightly and the walking toy crawls on the floor.

15. A walking toy of claim 9, wherein all of the leg portions are bent slightly and the walking toy crawls on the floor.

16. A walking toy of claim 10, wherein all of the leg portions are bent slightly and the walking toy crawls on the floor.

17. A walking toy of claim 1, wherein one set of the leg portions are bent deeply and other leg portions are bent slightly and the walking toy moves up and down in a rhythmic fashion.

18. A walking toy of claim 2, wherein one set of the leg portions are bent deeply and other leg portions are bent slightly and the walking toy moves up and down in a rhythmic fashion.

19. A walking toy of claim 3, wherein one set of the leg portions are bent deeply and other leg portions are bent-slightly and the walking toy moves up and down in a rhythmic fashion.

20. A walking toy of claim 4, wherein one set of the leg portions are bent deeply and other leg portions are bent slightly and the walking toy moves up and down in a rhythmic fashion.

21. A walking toy of claim 9, wherein one set of the leg portions are bent deeply and other leg portions are bent slightly and the walking toy moves up and down in a rhythmic fashion.

22. A walking toy of claim 10, wherein one set of the leg portions are bent deeply and other leg portions are bent slightly and the walking toy moves up and down in a rhythmic fashion.

23. A walking toy of claim 1, wherein the leg portions are bent at an angle that varies for each leg portion and the walking toy moves with unpredicted motion.

24. A walking toy of claim 2, wherein the leg portions are bent at an angle that varies for each leg portion and the walking toy moves with unpredicted motion.

25. A walking toy of claim 3, wherein the leg portions are bent at an angle that varies for each leg portion and the walking toy moves with unpredicted motion.

26. A walking toy of claim 4, wherein the leg portions are bent at an angle that varies for each leg portion and the walking toy moves with unpredicted motion.

27. A walking toy of claim 9, wherein the leg portions are bent at an angle that varies for each leg portion and the walking toy moves with unpredicted motion.

28. A walking toy of claim 10, wherein the leg portions are bent at an angle that varies for each leg portion and the walking toy moves with unpredicted motion.

* * * * *